US006183333B1

(12) United States Patent
Hall

(10) Patent No.: US 6,183,333 B1
(45) Date of Patent: Feb. 6, 2001

(54) RADIO CONTROLLED TOY SURFER

(75) Inventor: Jason Grant Venables Hall, Wombarra (AU)

(73) Assignee: Wombarra Innovations Pty. Ltd., Wombarra (AU)

( * ) Notice: Under 35 U.S.C. 154(b), the term of this patent shall be extended for 0 days.

(21) Appl. No.: 09/308,446

(22) PCT Filed: Dec. 1, 1997

(86) PCT No.: PCT/AU97/00813

§ 371 Date: May 19, 1999

§ 102(e) Date: May 19, 1999

(87) PCT Pub. No.: WO98/23345

PCT Pub. Date: Jun. 4, 1998

(30) Foreign Application Priority Data

Nov. 29, 1997 (AU) ..... PO3915

(51) Int. Cl.[7] ..... A63H 23/04; A63H 13/18; B63H 25/00; B63H 1/28; B63H 35/79

(52) U.S. Cl. ..... 446/154; 446/164; 446/326; 114/144 A; 114/270; 441/74

(58) Field of Search ..... 446/153, 154, 446/156, 160, 163, 164, 325, 326, 275, 351, 353, 354; 114/144 A, 360, 270, 55.56, 55.58; 441/65, 74, 79

(56) References Cited

U.S. PATENT DOCUMENTS

| | | | | |
|---|---|---|---|---|
| 3,276,050 | * | 10/1966 | Edwards | 441/74 |
| 3,405,677 | * | 10/1968 | Smith | 114/55.56 |
| 3,548,778 | * | 12/1970 | Von Smagala-Romanoff . | |
| 4,768,988 | | 9/1988 | Rutter . | |
| 4,923,427 | | 5/1990 | Roland . | |
| 5,582,529 | * | 12/1996 | Montgomery | 441/74 |
| 5,947,788 | * | 9/1999 | Derrah | 446/154 |

FOREIGN PATENT DOCUMENTS

51845/93 6/1994 (AU) .

* cited by examiner

*Primary Examiner*—D. Neal Muir
(74) *Attorney, Agent, or Firm*—Jordan and Hamburg LLP

(57) ABSTRACT

A toy surfboard or body board has a specially shaped bottom surface of the board to hold the waves in the same manner as in a full sized surfboard or body board. A figure of a surfer is positioned on the top surface to balance and maintain and bias the board to a flat running configuration. A compartment is located in the board to hold a radio receiver, controls, motor mechanisms and the batteries. A rudder is located rearwardly of the bottom mounted propeller.

33 Claims, 8 Drawing Sheets

RADIO CONTROLLED TOY SURFER

BACKGROUND OF THE INVENTION

The present invention relates to a radio controlled toy surfboard or body board, and in particular to a radio controlled surfboard or body board with a surfer mounted thereon.

Radio controlled toys such as cars, airplanes and boats are well known. However these toys are all controlled so as to be driven in the same manner as the real car, airplane or boat, by applying power to the wheels, or propellers, and to provide steering by turning the wheels of the toy car or the tail rudder or ailerons of the plane or the rudder of the boat. Hence it is a relatively easy matter to scale done the size of the components from the "real" vehicle to operate the toy vehicle.

However in the case of surfboard riding, a board is first propelled by the surfer laying or kneeling on the board and paddling with his arms to obtain sufficient speed to catch the wave. The surfer then stands and uses the position of his weight and body movement along the board to turn the board and maintain position on the wave or to leave the wave. It is therefor not a simple procedure to produce a toy surfboard which will operate in the same manner as a "real" surfboard.

SUMMARY OF THE INVENTION

The present invention has ameliorated this problem by providing a radio controlled toy surfboard which perform manoeuvres on a wave similar to those performed by a "real" surfboard.

In one broad form the invention comprises a radio controlled toy surfboard or body board comprising:

a board having a top surface, a bottom surface, a front end, and a tail end;

a figure of a surfer located on the top surface and being so positioned and constructed as to provide a balance to maintain and to bias the board into a flat running position;

a compartment within the surfboard to hold the radio receiver and the controls and the motor;

a drive propeller located near the tail of the board; and a rudder located between the propeller and the tail of the board.

the bottom of the board being so shaped as to hold the waves in the same manner as a full size surfboard.

In another form the invention comprises a radio controlled toy surfboard or body board comprising:

a board having a top surface, a bottom surface, a front end, and a tail end;

a figure of a surfer located on the top surface and being so positioned and constructed as to provide a balance to maintain and to bias the board into a flat running position;

a compartment within the surfboard to hold the radio receiver and the controls and the motor;

a drive propeller located near the tail of the board; and a rudder located between the propeller and the tail of the board.

the bottom of the board being shaped with a upswept nose portion, being rolled in cross section, with a central section having two concave channels and a stepped runner at each edge, and a relative flat section adjacent the tail, so as to hold the waves in the same manner as a full size surfboard.

In a further form the invention comprises a radio controlled toy surfboard or body board comprising:

a board having a top surface, a bottom surface, a front end, and a tail end;

a figure of a surfer located on the top surface and being so positioned and constructed as to provide a balance to maintain and to bias the board into a flat running position;

a compartment within the surfboard to hold the radio receiver and the controls and the motor;

a drive propeller located near the tail of the board; and a rudder located between the propeller and the tail of the board.

the bottom of the board being shaped with a upswept nose portion, being rolled in cross section, with a central section having an oval shaped lifting surface extending along the board and out of the board with two concave channels extending there along, and a stepped runner at each edge of the board, a small fin located adjacent the rear of the oval shaped lifting surface and a relative flat section adjacent the tail, so as to hold the waves in the same manner as a full size surfboard.

Preferably the rudder comprises an outer ring with a three bladed elongated spoke extending within the ring and beyond said ring, towards and aligned with the propeller.

The present invention will now be described with reference to the accompanying drawings in which like reference numerals designate the same elements.

DETAILED DESCRIPTION OF THE INVENTION

Figure 1:
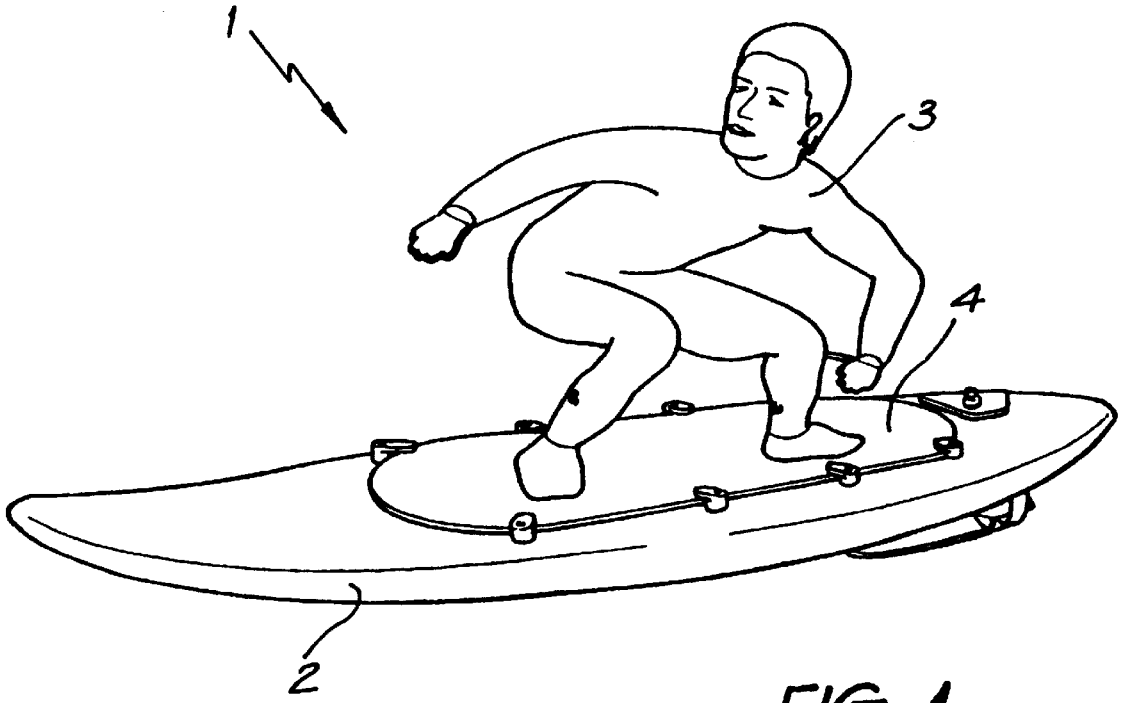
FIG. 1 shows a perspective view of a radio controlled toy surfboard according to one embodiment of the present invention.

As is shown in FIG. 1, the radio controlled toy surfboard (1), comprises an elongated surfboard body (2) with a surfer figure (3) mounted on a cover (4) which is located above and seals the cavity (5). The surfer figure (3) is preferably positioned in a crouched position as shown. Apart from the aesthetics, the surfer figure (3) provides an essential feature to provide for the flat running of the surfboard body (2), in that it provides a balance for the surfboard body. Further the surfer figure (3) is also either hollow or made from a material less dense than water, so that if the board (2) should tip, the floatation of the surfer figure (3) rights the board (2).

Figure 10:
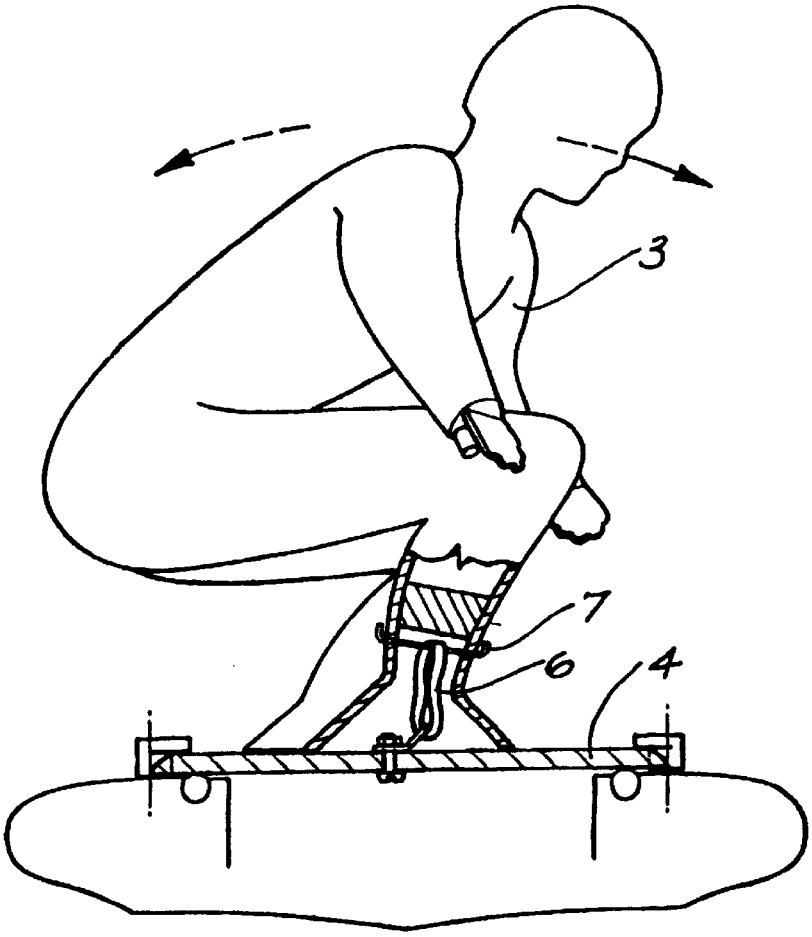
FIG. 10 is a partial cut away view of the surfer figure and cavity cover of the toy surfboard as illustrated in FIG. 1.

To assist in the performance, the surfer figure (3), as shown in FIG. 10, is hingedly attached to the cover (4), to absorb shocks and to provide a more realistic appearance. As shown, the figure (3) is attached by a rubber band (6) on a pin (7) to a stud (8) on the cover (4), allowing for the surfer figure (3) to pivot during movement of the board body (2) and to spring back into position to assist in effective turns and to right the board in the case of the board body (2) flipping over. This could be replaced by any suitable hinge system such as stainless steel spring.

Figure 3:
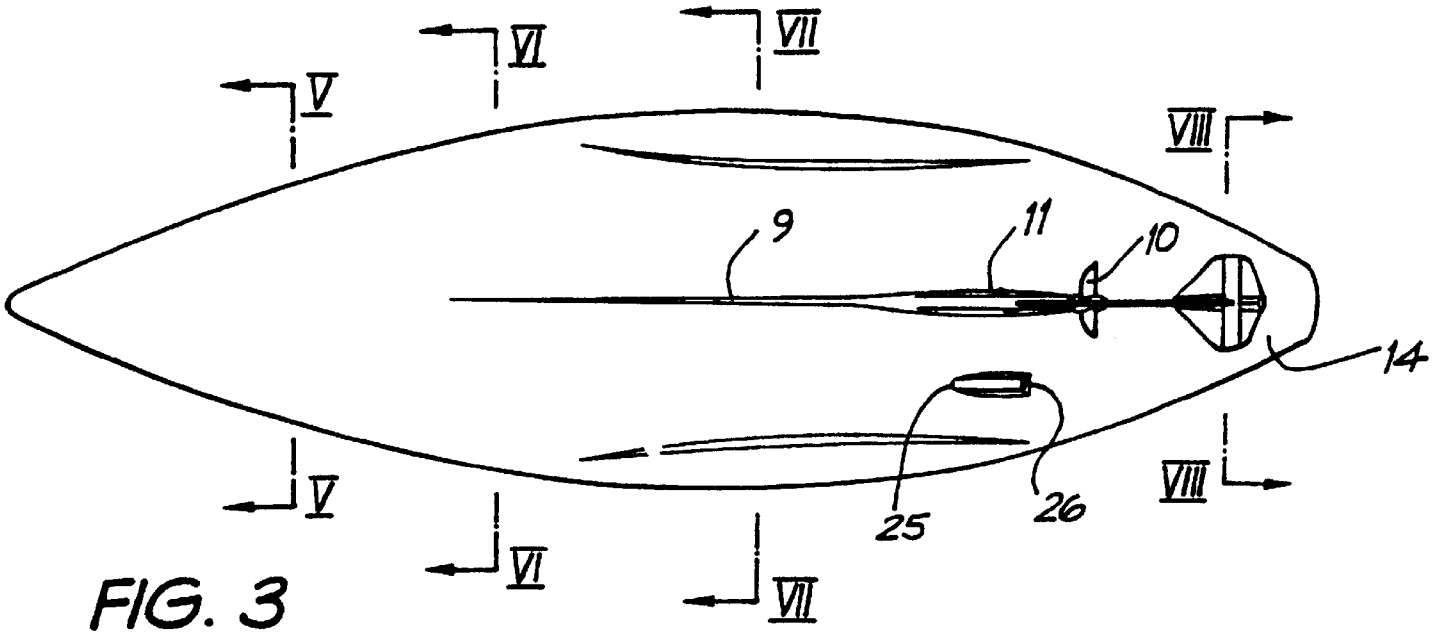
FIG. 3 shows a bottom view of the toy surfboard shown in FIG. 1.
Figure 4:
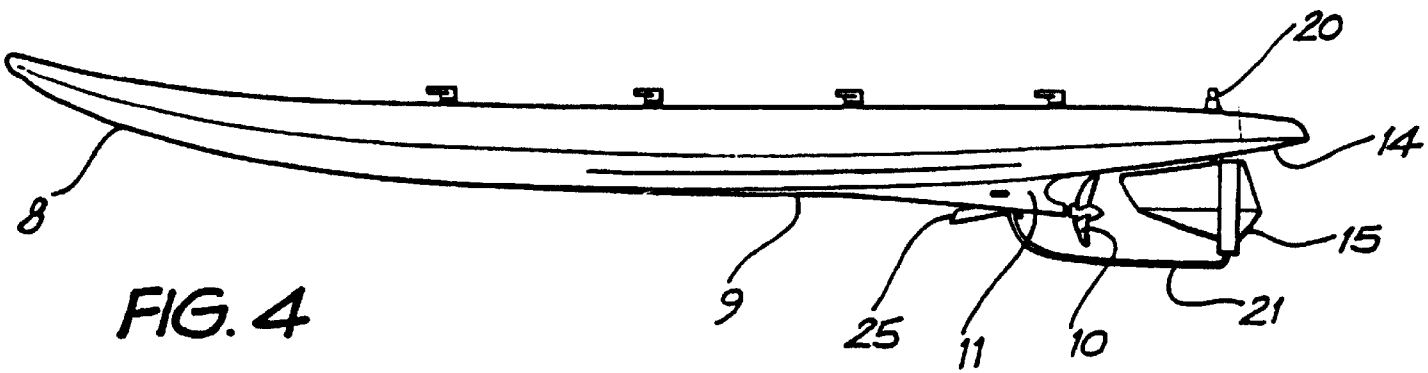
FIG. 4 shows a side view of the toy surfboard shown in FIG. 1.
Figure 5:
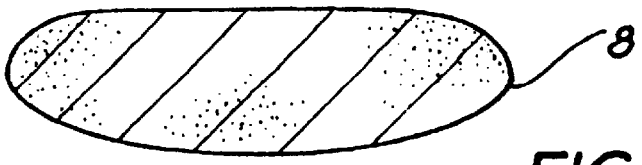
FIG. 5 is a cross sectional view taken through the toy surfboard as illustrated in FIG. 3 in the direction of the arrows V—V.

A preferred shape of the board body (2) is shown in FIGS. 3 to 8. As shown in FIG. 4, the front (8) of the body board (2) is upturned, and is curved in profile, as shown in FIG. 5. Further down the board body (2), a small blunt keel (9) extends along the centre of the board body (2) to form the housing (11) for the propeller (10). The keel (9) is preferably gently curved to assist in smooth turning of the board body (2) through the water.

Figure 6:
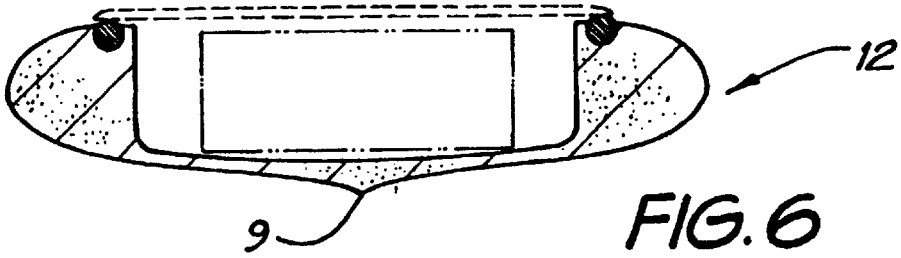
FIG. 6 is a cross sectional view taken through the toy surfboard as illustrated in FIG. 3 in the direction of the arrows VI—VI.
Figure 7:
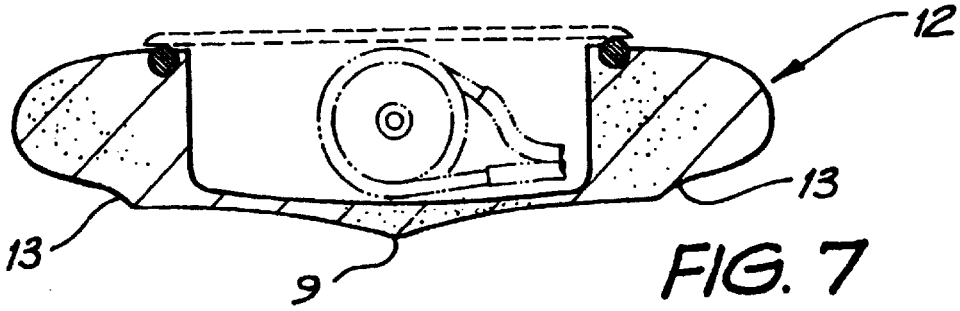
FIG. 7 is a cross sectional view taken through the toy surfboard as illustrated in FIG. 3 in the direction of the arrows VII—VII.

A concave channel extend along the middle section (12) of the board body (2) on both sides of the blunt keel (9) as shown in FIGS. 6 & 7. Also a stepped runner (13) extends along the edges (14) adjacent the middle section, (12) as shown in FIGS. 3, 4 & 7. Each change in slope is preferably smooth to assist the smooth travel of the bodyboard body (2) across the wave.

Figure 8:
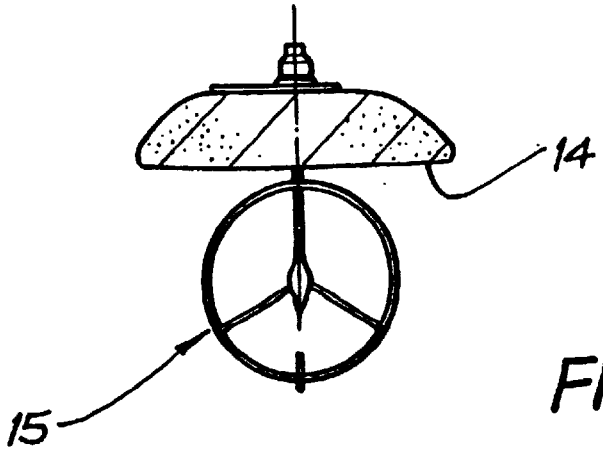
FIG. 8 is a cross sectional view taken through the toy surfboard as illustrated in FIG. 3 in the direction of the arrows VIII—VIII.
Figure 9:
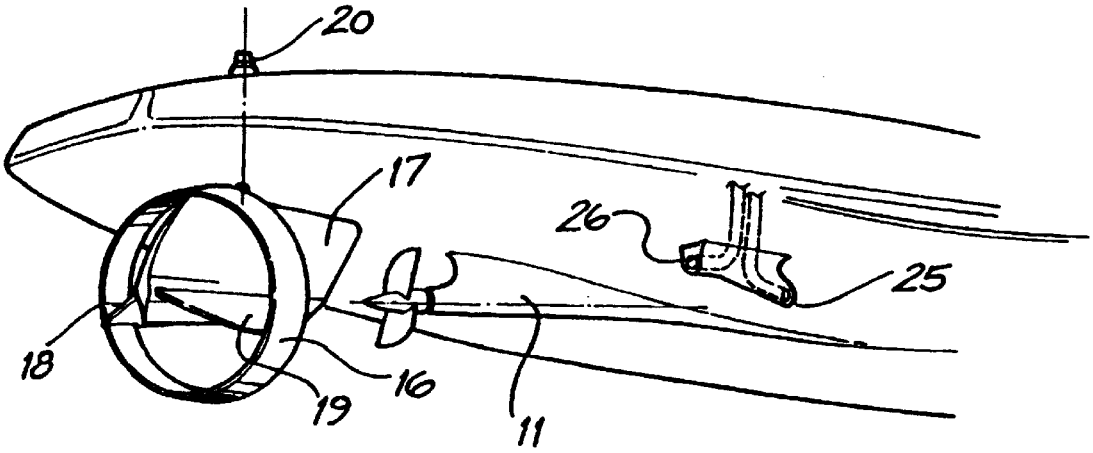
FIG. 9 is a close up view of the underside of the tail of the toy surfboard as shown in FIG. 1.

To assist in ease of turning, the tail section (14) has a relatively flat bottom, as shown in FIG. 8. The steering and propulsion system is also located at the tail (14) of the board body (2). As shown in FIGS. 3, 4 & 9, a propeller (10) extends from the housing (11) which is an extension of the blunt keel (9). Located adjacent the end of the tail section (14) is a specially shaped rudder (15). The rudder (15) comprises an annular member (16) with a trifurcated directional blade (17), which comprises a vertical orientated elongated blade (17) extending towards the propeller (10), with two blades (18 & 19) orientated at approximately 120° from each other, and extending along the bottom of the vertical blade (17). Preferably the two blades (18 & 19) are triangular in shape, with the vertically orientated blade (17) being some what parallelogram in shape. The rudder (15) pivots on the shaft (20). A propeller guard (21) extends from the annular member (16) to the housing (11). It has been found that a rudder of this configuration provides an effective directional control of the toy surfboard.

Figure 2:
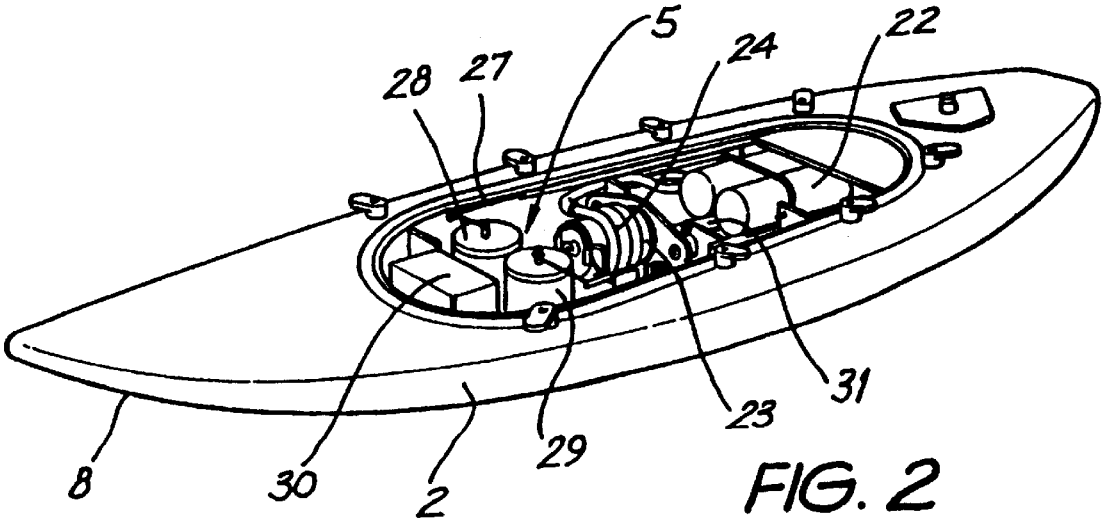
FIG. 2 shows a view of the cavity for the guidance and power system of the radio controlled toy surfboard as shown in FIG. 1.

As shown in FIG. 2, the control and propulsion system is mounted in the cavity (5). To assist in the flat running and in effective turning, it is preferable to have the batteries (22) located at the rear of the cavity. The toy surfboard (1) is powered by a suitable electric motor (23), which is water cooled by means of the coil (24), which has its inlet (25) and outlet (26), positioned as shown in FIG. 9, such that as the toy surfboard (1) travels through the water, water flows through the coil (24). In the embodiment shown the motor (23) is directly connected to the propeller shaft (31).

The radio control receiver (30) and operating mechanisms (28 & 29) are located in the front of the cavity (5). A push rod (27) is connected from the operating mechanism (28) to a lever (not shown) rigidly connected to the rudder (15). Another operating mechanism (29) controls the speed of the motor (23). The antennae can be connected to the surfer figure (3) or formed integrally therewith or even be free standing.

As in surfing, it is important that the weight distribution of the components be correct for the shape of the bottom of the board to ensure that the board runs flat and that the turns are effective.

Figure 11:
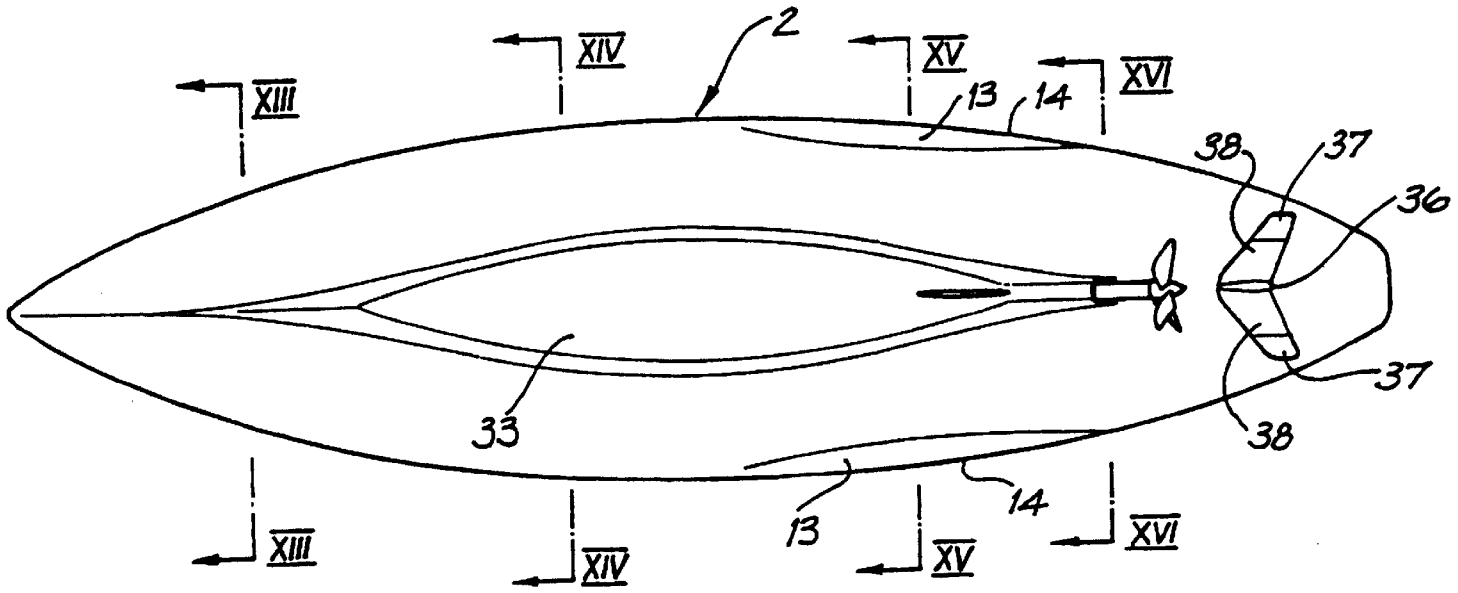
FIG. 11 is a bottom plan view of a toy surfboard according to another embodiment of the present invention with the top cover and surfer figure removed.
Figure 12:
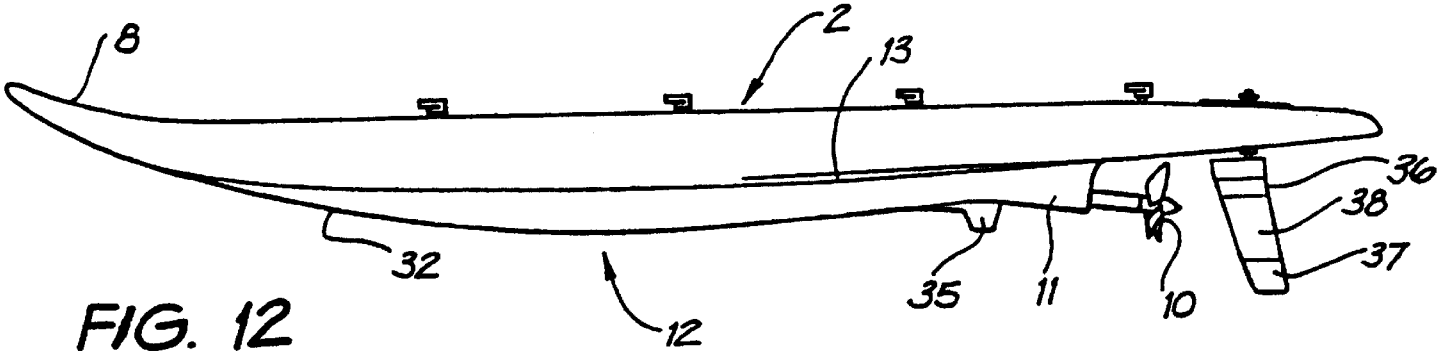
FIG. 12 is a side view of the toy surfboard shown in FIG. 11.
Figure 13:
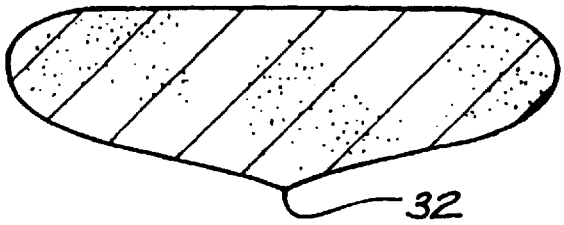
FIG. 13 is a cross sectional view taken through the toy surfboard as illustrated in FIG. 11 in the direction of the arrows XIII—XIII.
Figure 14:
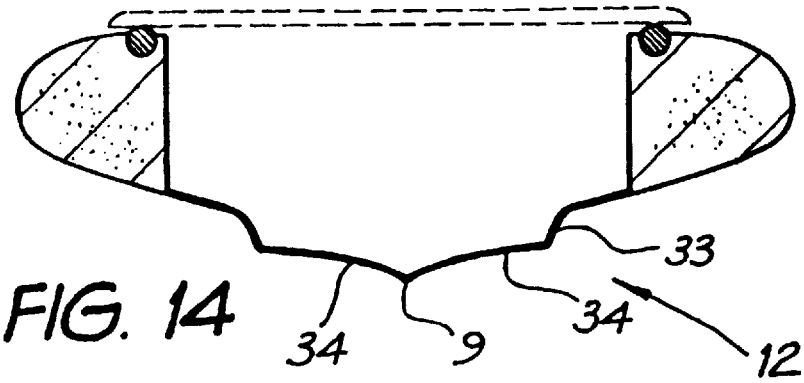
FIG. 14 is a cross sectional view taken through the toy surfboard as illustrated in FIG. 11 in the direction of the arrows XIV—XIV.
Figure 15:
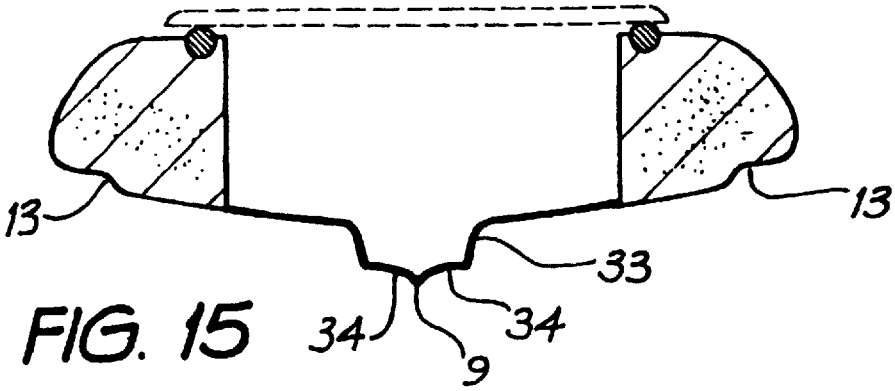
FIG. 15 is a cross sectional view taken through the toy surfboard as illustrated in FIG. 11 in the direction of the arrows XV—XV.
Figure 16:
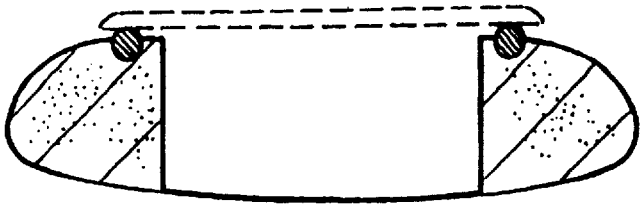
FIG. 16 is a cross sectional view taken through the toy surfboard as illustrated in FIG. 11 in the direction of the arrows XVI—XVI.

A further embodiment of a toy surfboard is shown in FIGS. 11 to 16, in which the front (8) of the board body (2) is also upturned and is curved in profile with a small keel (32) as shown in FIG. 13. Further along the board body (2) an oval shaped lifting surface (33) projects from the middle section (12) of the underneath of the board body (2). Two concave channels (34) run on either side of the keel (9) along the oval shaped lifting surface (33) as shown in FIGS. 14 & 15; the keel (9) continuing along the board to form the housing (11) for the propeller (10). A small fin (35) projects from the housing (11). Adjacent the rear of the oval lifting surface (33), are stepped runners (13) located on the underneath of the edges (14) as shown in FIGS. 11 and 15.

In this embodiment a bifurcated rudder (36) is used, having the arms (38) angled away from each other and the free ends (37) of the arms (38) projecting outwardly at an angle to the plane of the arms (38). A propeller guard similar to that of the previous embodiment can be used. Apart from the shape of the hull and propeller this embodiment is constructed in a similar manner as the previous embodiment.

Figure 17:
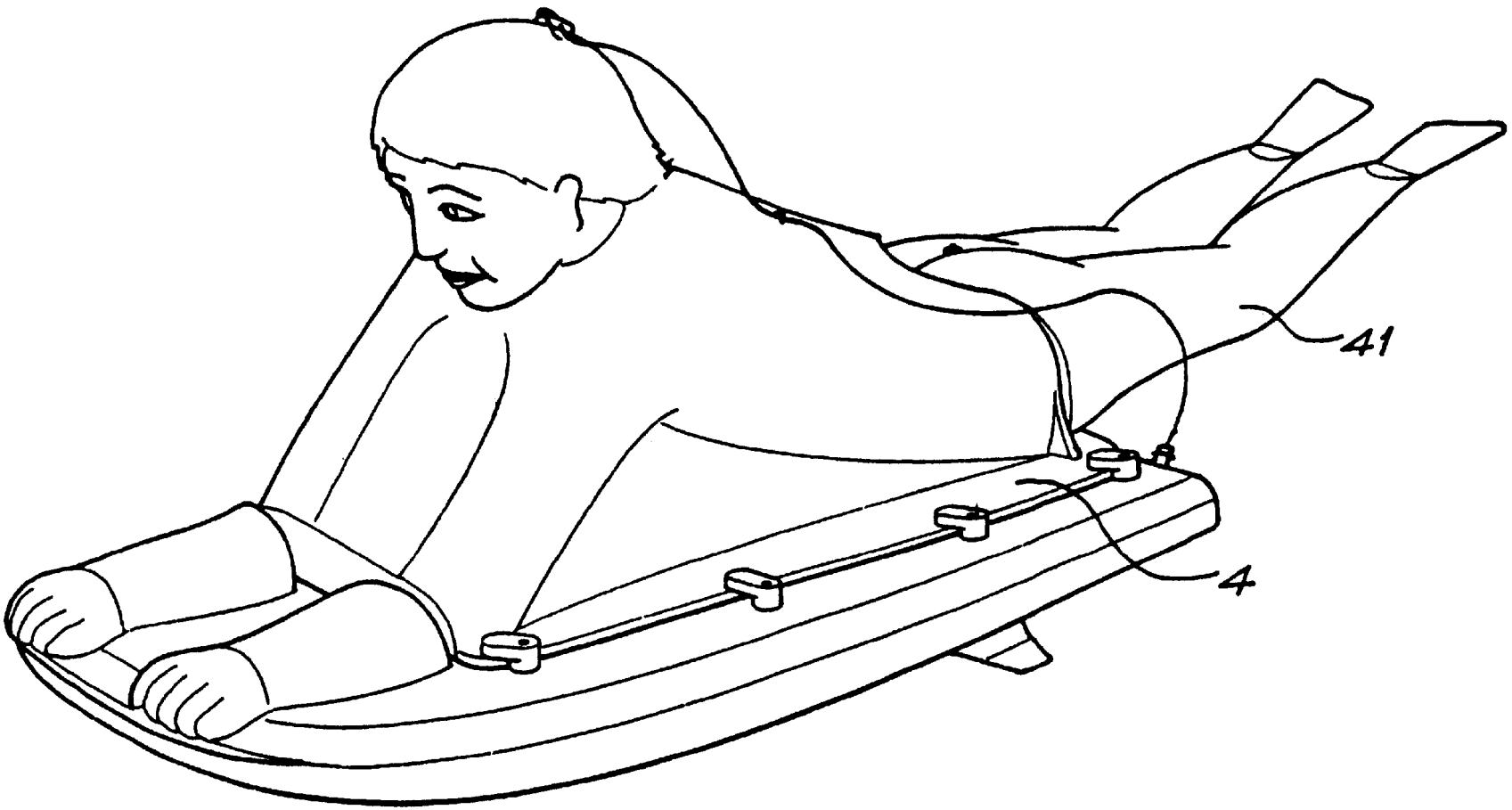
FIG. 17 illustrates a perspective view of a radio controlled toy body board according to another embodiment of the present invention.
Figure 18:
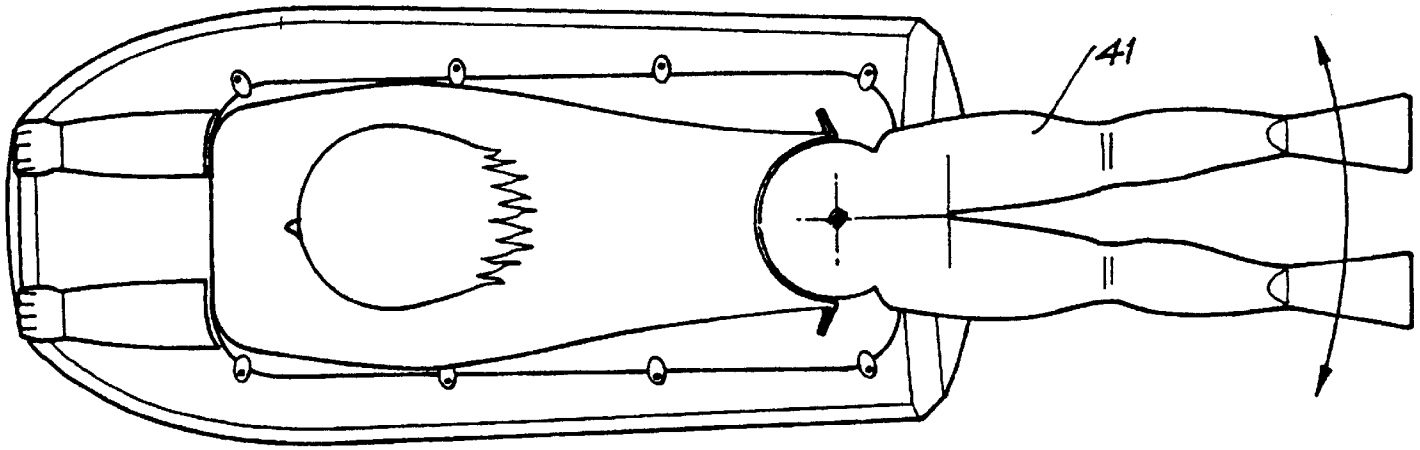
FIG. 18 illustrates a plan view of the radio controlled toy body board illustrated in FIG. 17.
Figure 19:
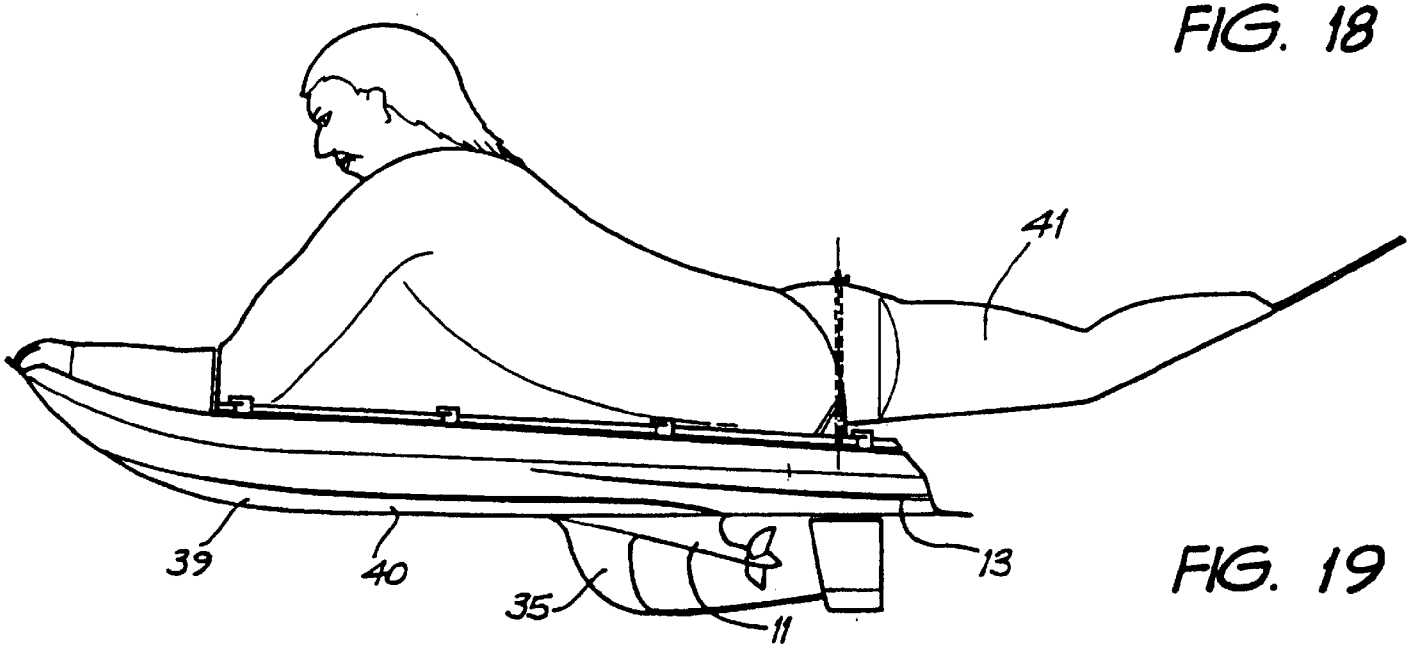
FIG. 19 illustrates a side view of the radio controlled toy body board illustrated in FIG. 17.

A further embodiment is shown in FIGS. 17 to 19, in which the invention is applied to a radio controlled body board toy. The underneath of the board can be similar to the previously described embodiments. However in this embodiment the keel (39) is a tear drop shaped lifting surface (40) projecting out of the plane of the underneath of the board body (2) and similarly constructed as the oval shaped lifting surface (33) of the previous embodiment. Stepped runners (13) extend, adjacent the edges, from approximately the middle of the board to the rear of the board.

The lay out of the components in the cavity of the board are similar to the previous embodiments. The figure (3) rather than standing on the cover (4) is located on the cover (4) in a reclined position, with the legs (41) pivotally connected to the cover (4), such that the legs (41) move from side to side as the board turns through the water.

It should be obvious to people skilled in the art that variations and modifications, such as using a water jet propulsion system, or cable operated controls, can be made to the embodiments described without departing from the spirit and the scope of the present invention.

What is claimed is:

1. A radio controlled toy comprising:

a board having a top surface, a bottom surface, a front end, and a tail end;

a figure of a surfer located on the top surface and being so positioned and constructed as to provide a balance to maintain and to bias the board into a flat running position;

a compartment within the board to hold radio receiver and controls and motor;

a drive propeller located near the tail end of the board; and a rudder located between the propeller and the tail end of the board;

the bottom surface of the board being shaped with a upswept nose portion, being rolled in cross section, with a central section having two concave channels and a stepped runner at each edge, and a relative flat section adjacent the tail end, so as to hold the waves in the same manner as a full size surfboard.

2. A radio controlled toy according to claim 1, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear.

3. A radio controlled toy according to claim 2 wherein the motor is water cooled, by means of a coil mounted around the motor, and has an inlet located facing the front end of the board such that as the board moves through the water, water flows through the coil, to cool the motor.

4. A radio controlled toy according to claim 1, wherein the rudder comprises an outer ring having a trifurcated directional blade extending therein and forwardly towards the propeller with one of the arms of the blade being vertically orientated with the other two arms extending along the bottom of the vertically orientated arm.

5. A radio controlled toy according to claim 1, wherein the rudder is bifurcated having its two arms extending away from the board bottom and away from each other with their free ends extending away from each other and outwardly at an angle to the plane of the respective arm.

6. A radio controlled toy according to claim 1, wherein the surfer has a relative density less than that of water.

7. A radio controlled toy according to claim 6, wherein the surfer is hingedly mounted on the board and biased to return to the surfing position so as to pivot during movement of the board and to return to the surfing position to assist in effective turning of the board.

8. A radio controlled toy according to claim 1, wherein legs of the surfer extend rearwardly beyond the board and are pivotally connected to the board to pivot transversely to the plane of the board.

9. A radio controlled toy comprising:

a board having a top surface, a bottom surface, a front end, and a tail end;

a figure of a surfer located on the top surface and being so positioned and constructed as to provide a balance to maintain and to bias the board into a flat running position;

a compartment within the board to hold radio receiver and controls and motor;

a drive propeller located near the tail end of the board; and a rudder located between the propeller and the tail end of the board;

the bottom surface of the board being shaped with a upswept nose portion, being rolled in cross section, with a central section having an oval shaped lifting surface extending along the board and out of the board with two concave channels extending there along, and a stopped runner at each edge of the board, a small fin located adjacent the rear of the oval shaped lifting surface and a relative flat section adjacent the tail end, so as to hold the waves in the same manner as a full size surfboard.

10. A radio controlled toy according to claim 9, wherein the rudder is bifurcated having its two arms extending away from the board bottom surface and away from each other with their free ends extending away from each other and outwardly at an angle to the plane of the respective arm.

11. A radio controlled toy according to claim 9, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear.

12. A radio controlled toy according to claim 11, wherein the motor is water cooled, by means of a coil mounted around the motor, and has an inlet located facing the front end of the board such that the board moves through the water, water flows through the coil, to cool the motor.

13. A radio controlled toy according to claim 9, wherein the surfer has a relative density less than that of water.

14. A radio controlled toy according to claim 13, wherein the surfer is hingedly mounted on the board and biased to return to the surfing position so as to pivot during movement of the board and to return to the surfing position to assist in effective turning of the board.

15. A radio controlled toy comprising:

a board having a top surface, a bottom surface, a front end, and a tail end;

a figure of a surfer, having a relative density less than that of water, located on the top surface and being so positioned and constructed as to provide a balance to maintain and to bias the board into a flat running position, the figure of the surfer being hingedly mounted on the board and biased to return to the surface position so as to pivot during movement of the board and to return to the surfing position to assist in effective turning of the board;

a compartment within the surfboard to hold radio receiver and controls and motor;

a drive propeller located near the tail end of the board; and a bifurcated rudder located between the propeller and the tail end of the board, and having its two arms extending away from the board bottom and away from each other with their free ends extending away from each other and outwardly at an angle to the plane of the respective arm;

the bottom surface of the board being shaped with a upswept nose portion, being rolled in cross section, with a central section having two concave channels and a stepped runner at each edge, and a relative flat section adjacent the tail end, so as to hold the waves in the same manner as a full size surfboard.

16. A radio controlled toy according to claim 15, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear.

17. A radio controlled toy according to claim 16 wherein the motor is water cooled, by means of a coil mounted around the motor, and having an inlet located facing the front of the board such that as the board moves through the water, water flows through the coil, to cool the motor.

18. A radio controlled toy comprising:

a board having a top surface, a bottom surface, a front end, and a tail end;

a figure of a surfer, having a relative density less than that of water, located on the top surface and being so positioned and constructed as to provide a balance to maintain and to bias the board into a flat running position, the figure of the surfer being hingedly mounted on the board and biased to return to the balance position so as to pivot during movement of the board and to return to the balance position to assist in effective turning of the board;

a compartment within the surfboard to hold radio receiver and controls and motor;

a drive propeller located near the tail end of the board; and a bifurcated rudder located between the propeller and the tail end of the board, and having its two arms extending away from the board bottom and away from each other with their free ends extending away from each other and outwardly at an angle to the plane of the respective arm;

the bottom surface of the board being shaped with a upswept nose portion, being rolled in cross section, with a central section having an oval shaped lifting surface extending along the board and out of the board with two concave channels extending there along, and a stopped runner at each edge of the board, a small fin located adjacent the rear of the oval shaped lifting surface and a relative flat section adjacent the tail end, so as to hold the waves in the same manner as a full size surfboard.

19. A radio controlled toy according to claim 18, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear.

20. A radio controlled toy according to claim 19 wherein the motor is water cooled, by means of a coil mounted around the motor, and has an inlet located facing the front end of the board such that as the board moves through the water, water flows through the coil, to cool the motor.

21. A radio controlled toy body board comprising:

a board having a top surface, a bottom surface, a front end, and a tail end;

a figure of a surfer located on the top surface and being so positioned and constructed as to provide a balance to maintain and to bias the board into a flat running position, wherein legs of the surfer extend rearwardly beyond the board and are pivotally connected to the board to pivot transversely to the plane of the board;

a compartment within the board to hold radio receiver and controls and motor;

a drive propeller located near the tail end of the board; and a rudder located between the propeller and the tail end of the board;

the bottom surface of the board being shaped with a upswept nose portion, being rolled in cross section, with a central section having two concave channels and a stepped runner at each edge, and a relative flat section adjacent the tail end, so as to hold the waves in the same manner as a full size surfboard.

22. A radio controlled toy body board according to claim 21, wherein the rudder is bifurcated having its two arms extending away from the board bottom and away from each other with their free ends extending away from each other and outwardly at an angle to the plane of the respective arm.

23. A radio controlled toy body board according to claim 21, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source located at the rear.

24. A radio controlled toy body board according to claim 23, wherein the motor is water cooled, by means of a coil mounted around the motor, and has an inlet located facing the front end of the board such that as the board moves through the water, water flows through the coil, to cool the motor.

25. A radio controlled toy body board according to claim 21, wherein the surfer has a relative density less than that of water.

26. A radio controlled toy body board comprising:

a board having a top surface, a bottom surface, a front end, and a tail end;

a figure of a surfer located on the top surface and being so positioned and constructed as to provide a balance to maintain and to bias the board into a flat running position, wherein legs of the surfer extend rearwardly beyond the board and are pivotally connected to the board to pivot transversely to the plane of the board;

a compartment within the board to hold radio receiver and controls and motor, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear, and wherein the motor is water cooled, by means of a coil mounted around the motor, and has an inlet located facing the front end of the board such that as the board moves through the water, water flows through the coil, to cool the motor;

a drive propeller located near the tail end of the board; and a bifurcated rudder located between the propeller and the tail end of the board and having its two arms extending away from the board bottom and away from each other with their free ends extending away from each other and outwardly at an angle to the plane of the respective arm;

the bottom surface of the board being shaped with a upswept nose portion, being rolled in cross section, with a central section having two concave channels and a stepped runner at each edge, and a relative flat section adjacent the tail end, so as to hold the waves in the same manner as a full size surfboard.

27. A radio controlled toy body board according to claim 26, wherein the surfer has a relative density less than that of water.

28. A radio controlled toy body board comprising:

a board having a top surface, a bottom surface, a front end, and a tail end;

a figure of a surfer located on the top surface and being so positioned and constructed as to provide a balance to maintain and to bias the board into a flat running position, wherein legs of the surfer extend rearwardly beyond the board and are pivotally connected to the board to pivot transversely to the plane of the board;

a compartment within the board to hold radio receiver and controls and motor;

a drive propeller located near the tail end of the board; and a rudder located between the propeller and the tail end of the board;

the bottom surface of the board being shaped with a upswept nose portion, being rolled in cross section, with a central section having an oval shaped lifting surface extending along the board and out of the board with two concave channels extending there along, and a stopped runner at each edge of the board, a small fin located adjacent the rear of the oval shaped lifting surface and a relative flat section adjacent the tail end, so as to hold the waves in the same manner as a full size surfboard.

29. A radio controlled toy body board according to claim 28, wherein the rudder is bifurcated having its two arms extending away from the board bottom and away from each other with their free ends extending away from each other and outwardly at an angle to the plane of the respective arm.

30. A radio controlled toy body board according to claim 28, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear.

31. A radio controlled toy body board according to claim 30, wherein the motor is water cooled, by means of a coil mounted around the motor, and has an inlet located facing the front end of the board such that as the board moves through the water, water flows through the coil, to cool the motor.

32. A radio controlled toy body board according to claim 28, wherein the surfer has a relative density less than that of water.

33. A radio controlled toy body board comprising:

a board having a top surface, a bottom surface, a front end, and a tail end;

a figure of a surfer located on the top surface and being so positioned and constructed as to provide a balance to maintain and to bias the board into a flat running position, wherein legs of the surfer extend rearwardly beyond the board and are pivotally connected to the board to pivot transversely to the plane of the board;

a compartment within the board to hold radio receiver and controls and motor, wherein the compartment is accessible from the top surface of the board and is releasably sealed by a cover upon which the surfer is mounted, said compartment having a radio control receiver, and steering and speed operating servo motors mounted at the front thereof, with a motor in the middle section to drive the propeller and batteries, as the power source, located at the rear, and wherein the motor is water cooled, by means of a coil mounted around the motor, and has an inlet located facing the front end of the board such that as the board moves through the water, water flows through the coil, to cool the motor;

a drive propeller located near the tail end of the board; and a rudder located between the propeller and the tail end of the board;

the bottom surface of the board being shaped with a upswept nose portion, being rolled in cross section, with a central section having an oval shaped lifting surface extending along the board and out of the board with two concave channels extending there along, and a stopped runner at each edge of the board, a small fin located adjacent the rear of the oval shaped lifting surface and a relative flat section adjacent the tail end, so as to hold the waves in the same manner as a full size surfboard.

* * * * *